United States Patent [19]

Aihara et al.

[11] Patent Number: 5,030,066

[45] **Date of Patent: * Jul. 9, 1991**

[54] VARIABLE-DELIVERY VANE-TYPE ROTARY COMPRESSOR

[75] Inventors: Toshinori Aihara; Yukio Sudo, both of Atsugi, Japan

[73] Assignee: Atsugi Motor Parts Co., Ltd., Kanagawa, Japan

[ * ] Notice: The portion of the term of this patent subsequent to Aug. 22, 2006 has been disclaimed.

[21] Appl. No.: 99,116

[22] Filed: Sep. 21, 1987

[30] Foreign Application Priority Data

Sep. 24, 1986 [JP] Japan ..... 61-225563

[51] Int. Cl.[5] ..... F04C 18/344; F04C 29/08

[52] U.S. Cl. ..... 417/295; 417/310

[58] Field of Search ..... 417/295, 310, 440; 418/78

[56] References Cited

U.S. PATENT DOCUMENTS

| | | | |
|---|---|---|---|
| 2,899,903 | 8/1959 | Ryder | 418/258 |
| 3,451,614 | 6/1969 | Tosh | 417/440 |
| 3,515,496 | 6/1970 | Eddy | 417/440 |
| 3,799,707 | 3/1974 | Newton | 418/78 |
| 4,060,343 | 11/1977 | Newton | 417/310 |
| 4,137,018 | 1/1979 | Brucken | 417/440 |
| 4,557,670 | 12/1985 | Inagaki | 417/310 |
| 4,726,740 | 2/1988 | Suzuki | 417/310 |
| 4,744,732 | 5/1988 | Nakajima | 417/259 |
| 4,778,352 | 10/1988 | Nakajima | 417/295 |

FOREIGN PATENT DOCUMENTS

| | | | |
|---|---|---|---|
| 174516 | 3/1986 | European Pat. Off. | 417/310 |
| 3629199 | 3/1987 | Fed. Rep. of Germany | 417/310 |
| 157090 | 9/1982 | Japan | 417/440 |
| 111150 | 12/1985 | Japan | 417/295 |
| 259789 | 12/1985 | Japan | 417/295 |

*Primary Examiner*—Leonard E. Smith
*Attorney, Agent, or Firm*—Bachman & LaPointe

[57] ABSTRACT

A variable-delivery vane-type rotary compressor includes passage means for defining a by-pass passage establishing communication between an aspirator chamber and a compression chamber, the by-pass passage having end openings exposed to the aspirator chamber and the compression chamber; and control means for mechanically controlling the amount of fluid by-passed from the compression chamber to the aspirator chamber through the passage means in accordance with pressure in the aspirator chamber and a discharge chamber.

15 Claims, 5 Drawing Sheets

7
1
20c
21
5
17
11
16
10
1a
19
20
5
12
18
4
19
12
25
21
1c
16
10
5
26a
21c
17
5
11
22

VARIABLE-DELIVERY VANE-TYPE ROTARY COMPRESSOR

BACKGROUND OF THE INVENTION

1. Field of the Invention

The present invention relates to a rotary compressor, particularly to a variable-delivery vane-type rotary compressor which may be used as a refrigerant compressor for an air conditioner for a vehicle or the like.

2. Description of the Background Art

Generally, in order to control discharge in vane-type rotary compressor, a suction port being in communication with the interior of a cam ring is provided on a side-block which covers one end of the cam ring and the position of the suction port is changed, so that the starting position of compression caused by rotation of the vanes is changed.

For example, a variable-delivery vane-type rotary compressor, which is a background art of the present invention, includes an arc-shaped by-pass port, which is provided in a front plate so as to extend beside the cam surface of a cam ring, the end opening of which may open on any radial section of a working chamber, and a rotatable disc having an arc-shaped opening between the front plate and the cam ring. In this compressor, the rotatable disc may rotate by means of an electric motor provided within or outside the compressor so as to change the position of by-pass opening in order to control discharge.

However, since the rotatable disc rotates by means of the motor in these compressors, there is a disadvantage in that power consumption is increased. In addition, since various sensors, such as a pressure sensor, a temperature sensor and an air-quantity sensor, and electrical control circuits are used in order to control actuation of the motor, there are disadvantages in that construction of the compressor is complicated and the manufacturing cost is increased.

SUMMARY OF THE INVENTION

It is therefore a principal object of the present invention to eliminate the aforementioned disadvantage and to provide a rotary compressor which can automatically adjust its discharge according to the cooling load of an air conditioner. Another object of the invention is to provide a rotary compressor which has simple construction and which can decrease the manufacturing cost and fuel cost for an engine.

In order to accomplish the aforementioned and other specific objects, a rotary compressor, according to the present invention, includes passage means for defining a by-pass passage establishing communication between a low-pressure chamber and a compression chamber, the by-pass passage having end openings exposed to the low-pressure chamber and the compression chamber; and control means for mechanically controlling the amount of fluid by-passed from the compression chamber to the low-pressure chamber through the by-pass passage in accordance with pressure in the low-pressure chamber and a high-pressure chamber.

According to one aspect of the invention, a rotary compressor comprises:

a compressor housing defining therein an internal space which includes a low-pressure chamber connected to a low-pressure fluid source and a high-pressure chamber connected to a load;

introducing means for introducing a low-pressure fluid into the low-pressure chamber;

compression means for compressing the low-pressure fluid to a predetermined higher pressure, the compression means including a compression chamber for introducing the low-pressure fluid thereinto for compression;

passage means for defining a by-pass passage establishing communication between the low-pressure chamber and the compression chamber, the by-pass passage having end openings exposed to the low-pressure chamber and the compression chamber;

rotary closure member associated with one of the end openings of the by-pass passage for varying the open area of the end opening so as to control the amount of the low-pressure fluid by-passed from the compression chamber to the low-pressure chamber through the by-pass passage; and actuating means for actuating the rotary closure member and for mechanically controlling the amount of the low-pressure fluid, which is by-passed from the compression chamber to the low-pressure chamber through the passage means, in accordance with pressures in the low-pressure and high-pressure chambers.

The rotary closure member may comprise a disc-shaped member in which a by-pass opening is provided at the circumference thereof, the disc-shaped member being rotatably provided on the peripheral wall of the compression chamber. The by-pass opening is preferably an arc-shaped opening extending beside the outer periphery and the end opening of the by-pass passage is preferably a long arc-shaped opening corresponding to the by-pass opening.

The actuating means may comprise:

an actuator cylinder, in which a piston is housed, the piston causing the disc-shaped member to rotate;

a control valve supplying pressure to the actuator cylinder thereby actuating the piston;

a control cylinder having a control chamber which is in communication with the low-pressure chamber;

a control assembly which is provided in the control cylinder and which moves in the direction of the axis thereof in accordance with pressures in the low-pressure and high-pressure chambers so as to actuate the control valve.

The control valve may comprise a poppet valve connected to the control assembly and a ball valve which can be in communication with the high-pressure chamber. The ball valve is preferably opened to allow the rotary closure member to rotate by means of the actuator cylinder so as to increase the open area of the end opening of the by-pass passage when discharge of the compressor is excessive relative to the cooling load of an evaporator connected to the compressor and wherein the poppet valve is opened to allow the rotatable disc to rotate by means of the actuator cylinder so as to decrease the open area of the end opening of the by-pass passage when discharge of the compressor is not enough to satisfy the cooling demand of the evaporator. The control assembly may comprise a bellows and a coil spring, a piston or a diaphragm.

BRIEF DESCRIPTION OF THE DRAWINGS

The present invention will be understood more fully from the detailed description given herebelow and from the accompanying drawings of the preferred embodiment of the invention. The drawings are not intended to imply limitation of the invention to this specific embodiment, but are for explanation and understanding only.

In the drawings.

DESCRIPTION OF THE PREFERRED EMBODIMENT

Figure 1:
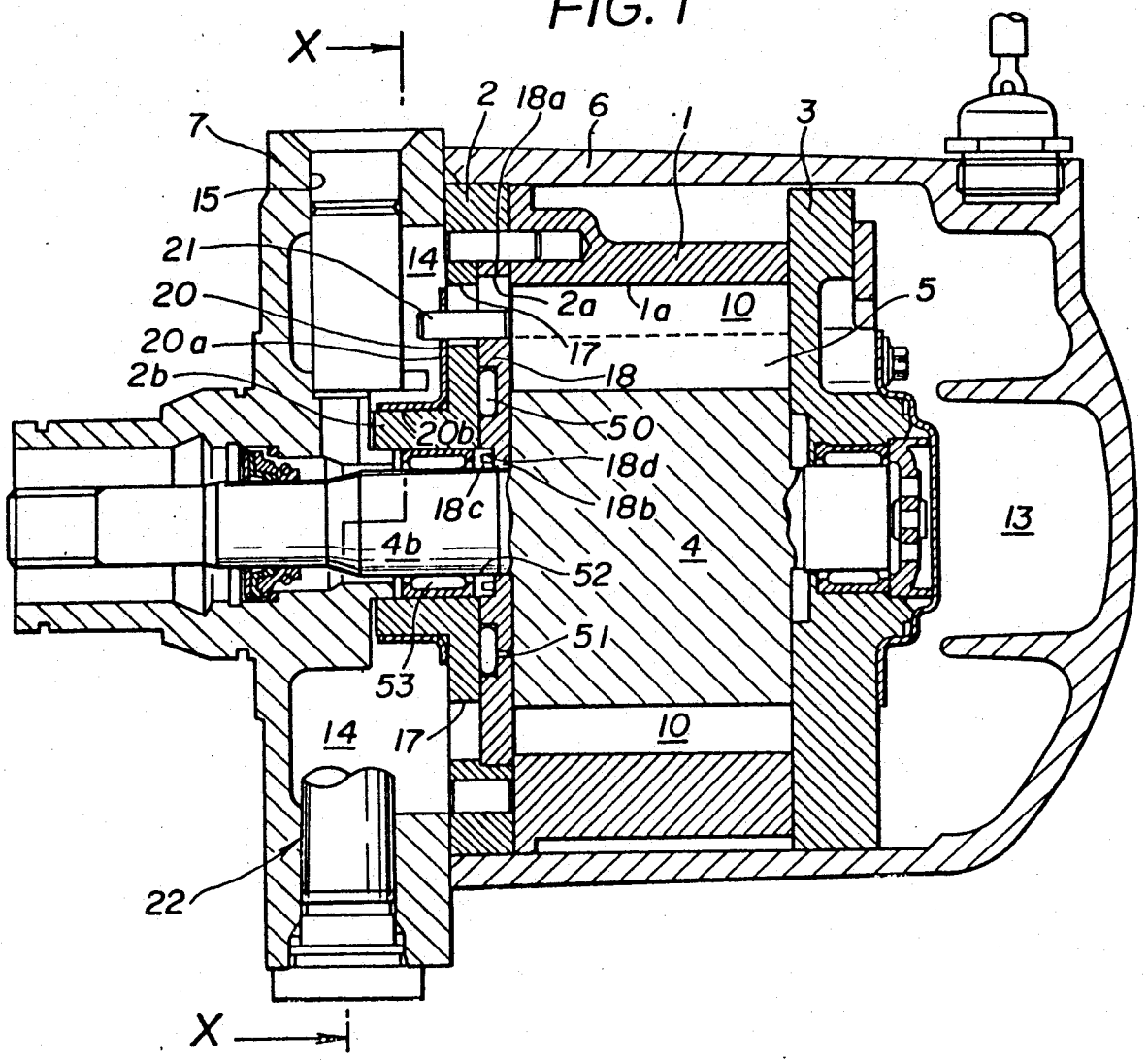
FIG. 1 is a sectional view of the preferred embodiment of a variable-delivery vane-type rotary compressor according to the present invention.
Figure 2:
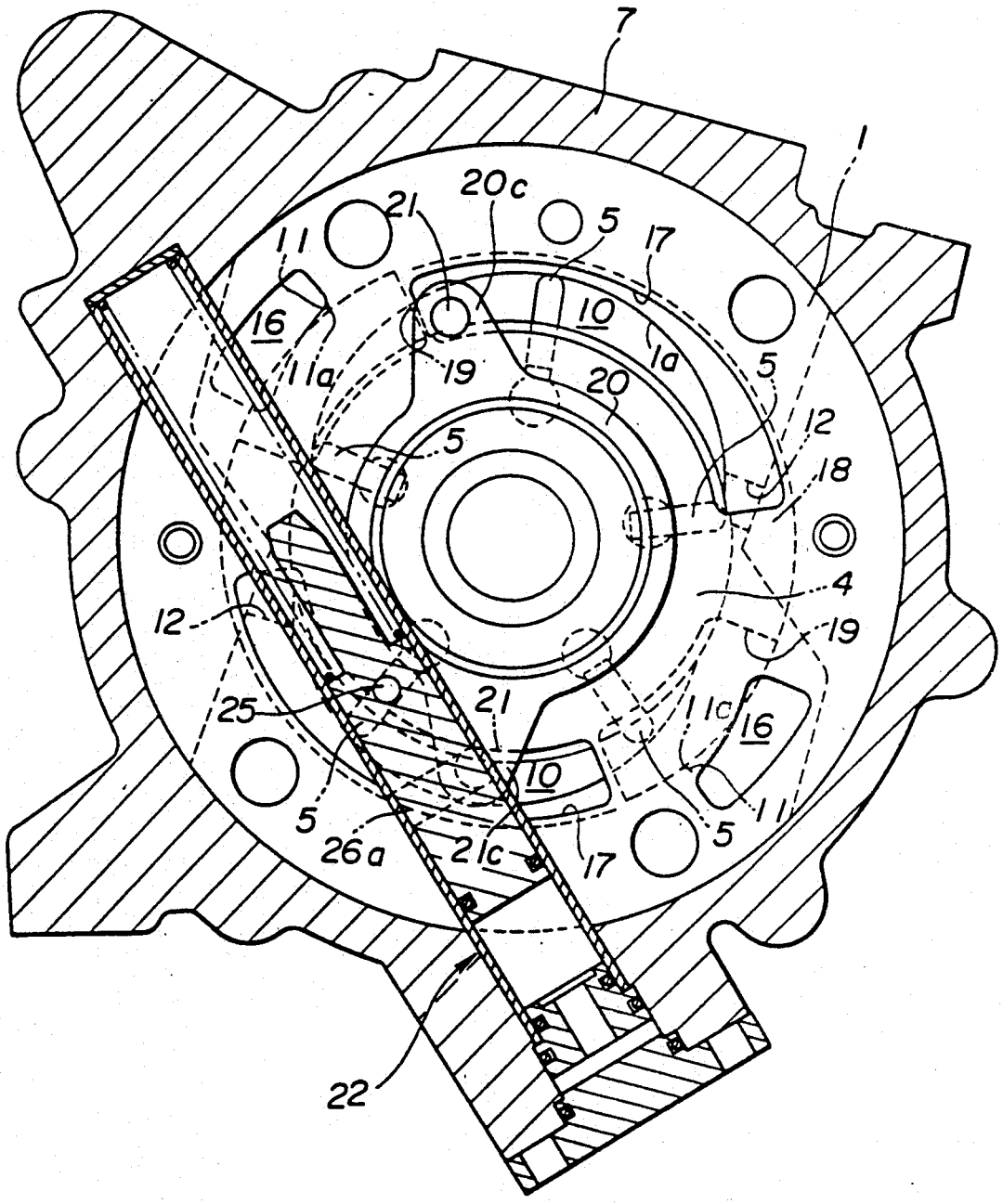
FIG. 2 is a sectional view of the compressor taken along the line X—X in FIG. 1.

Referring now to the drawings, particularly to FIGS. 1 and 2, a variable-delivery vane-type rotary compressor, according to the present invention, includes a cylindrical cam ring 1. A cam surface 1*a*, which has an essentially elliptical cross-section, is formed on the inside surface of the cam ring 1. The cam ring 1 is equiped with front and rear plates 2 and 3 at both of open ends in order to cover the open ends of the cam ring 1. A cylindrical rotor 4 is rotatably housed in the cam ring 1 between the front and rear plates 2 and 3. A plurality of vanes 5 are inserted into the rotor 4. The vanes 5 can move inwardly and outwardly so as to be in slidable contact with the cam surface 1*a*. The cam ring 1, the front and rear plates 2 and 3, the rotor 4 and vanes 5 are housed in a cylindrical housing 6 having a bottom. The front open end of the housing 6 is covered with a head cover 7 which is fixed to the housing 6 by means of a bolt.

A pair of working chambers 10 are formed by the cam ring 1, the front and rear plates 2 and 3 and the rotor 4. As shown in FIG. 2, the working chambers 10 respectively are in communication with a pair of suction ports 11, the end openings of which are formed in the cam surface 1*a*. In addition, a pair of discharge ports 12 is formed on the cam ring 1 at a location corresponding to the clockwise end of the working chamber 10. The communication between a discharge chamber 13, which is formed in the housing 6, and the working chamber 10 is established by means of a discharge valve provided in the discharge port 12.

The aspirator chamber 14 is formed by the front plate 2 and the head cover 7. The head cover 7 is provided with an inlet 15 through which a refrigerant gas is supplied to the aspirator chamber 14. The refrigerant gas is supplied to each of the working chambers 10 through a pair of suction openings 16, which are formed on the front plate 2, and the suction port 11 formed in the cam ring 1.

Figure 3:
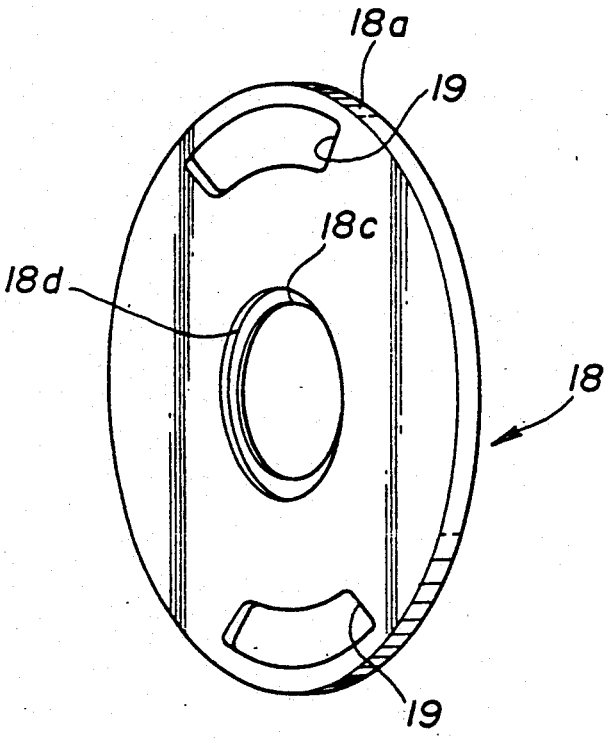
FIG. 3 is a perspective view of a rotatable plate used in the compressor.

In addition, a pair of arc-shaped by-pass ports 17 are formed on the front plate 2. As shown in FIG. 2, the by-pass port 17 extends along the working chamber 10 from a location, which is shifted clockwise from that of the verge 11*a* of the input port 11 beside the cam surface 1*a*, to a point near the discharge port 12 so as to establish the communication between the working chamber 10 and the aspirator chamber 14. A rotatable disc 18 is provided between the front plate 2, the cam ring 1 and the rotor 4. The rotatable disc 18 is rotatably supported about the axis of the rotor 4 so that the outer surface 18*a* of the rotatable disc 18 comes into contact with the inner surface 2*a* of the front plate 2. As shown in FIG. 3, the rotatable disc 18 is provided with a pair of arc-shaped by-pass openings 19 near the periphery thereof. The area of the by-pass port 17, which establishes the communication between the working chamber 10 and the aspirator chamber 14, can be adjusted by rotating the rotatable disc 18. When the area of the by-pass port 17 is increased, the amount of refrigerant by-passed from the working chamber 10 to the aspirator chamber 14 is increased so that the amount of discharge refrigerant is decreased. Conversely, when the area of the by-pass port 17 is decreased, the amount of discharged refrigerant is increased.

A ring plate 20 is provided between the front plate 2 and the head cover 7. The ring plate 20 comprises a plate portion 20*a* and a boss portion 20*b*. The plate portion 20*a* is in slidable contact with the opposing surface of the front plate 2 to the head cover 7 and the inner periphery of the boss portion 20*b* is in slidable contact with the outer periphery of the boss portion 2*b* of the front plate 2 so that the ring plate 20 can rotate. As shown in FIG. 2, the plate portion 20*a* of the ring plate 20 is provided with a pair of projecting portions 20*c* which project radially from the outer periphery of the plate portion 20*a*. The projecting portions 20*c* are connected to the rotatable disc 18 by means of a pair of actuating pins 21 which pass through the by-pass ports 17 of the front plate 2.

Figure 4:
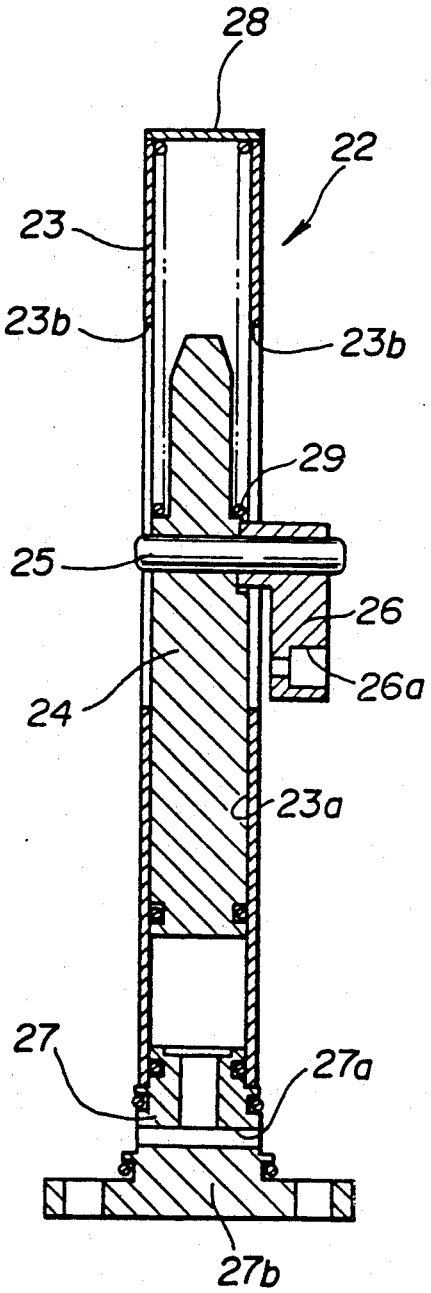
FIG. 4 is a front sectional view of an actuator cylinder used in the compressor.

In addition, the head cover 7 is provided with an actuator cylinder 22. As shown in FIG. 4, the actuator cylinder 22 comprises a cylinder portion 23, a piston slidably inserted into a cylinder 23*a* of the cylinder portion 23, and an arm portion 26 connected to the piston 24 by means of a pin 25. The bottom end of the cylinder portion 23 is provided with a cylinder bottom 27. The cylinder bottom 27 is provided with a supply port 27*a* which is in communication with the interior of the cylinder 23*a* and to which pressure is supplied in order to actuate the piston 24. The actuator cylinder 22 is provided with a flange 27*b* which is used for mounting the actuator cylinder 22 on the head cover 7. The top end of the cylinder portion 23 is covered with a plate 28. A coil spring 29 is provided between the inside wall of the plate 28 and the piston 24 so as to bias the piston in the downward direction in FIG. 4. The end of the arm portion 26 is provided with a long groove 26*a* extending perpendicular to the axis of the pin 25. As shown in FIG. 2, the actuating pin 21 engages the groove 26*a*. When the piston 24 is moved along the axis thereof, the longitudinal movement of the piston 24 is transmitted to the rotatable disc 18 by means of the actuating pin 21 so that the rotatable disc 18 rotates about the axis of the rotor 4. Furthermore, the cylinder portion 23 is provided with a pair of slits 23*b* extending in the direction of movement of the arm portion 26 and the piston 24 so as to allow the piston to move smoothly.

Figure 5:
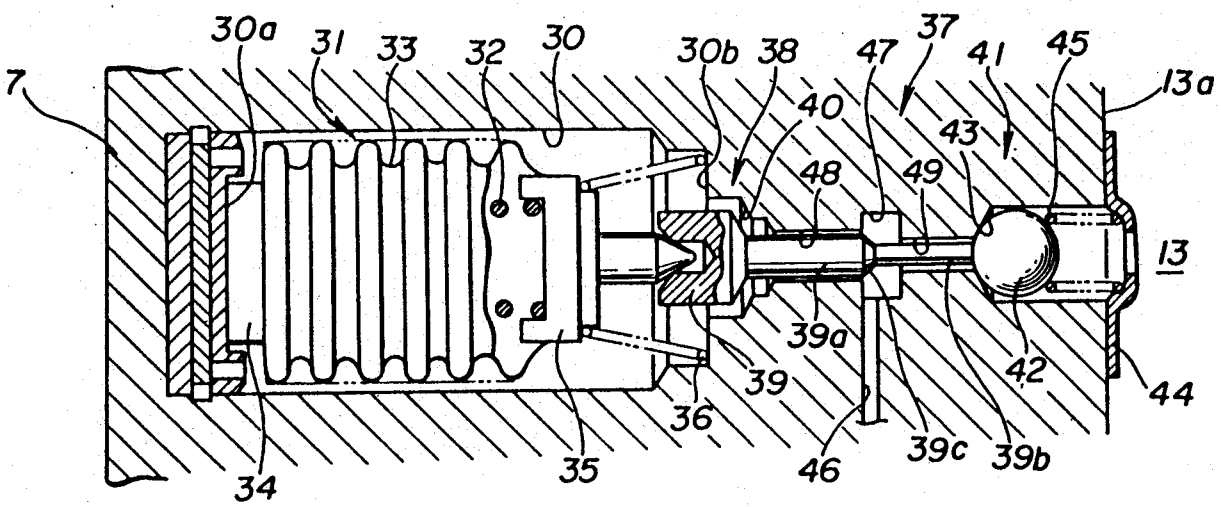
FIGS. 5 and 6 are front sectional views of a control assembly and control valves used in the compressor.
Figure 6:
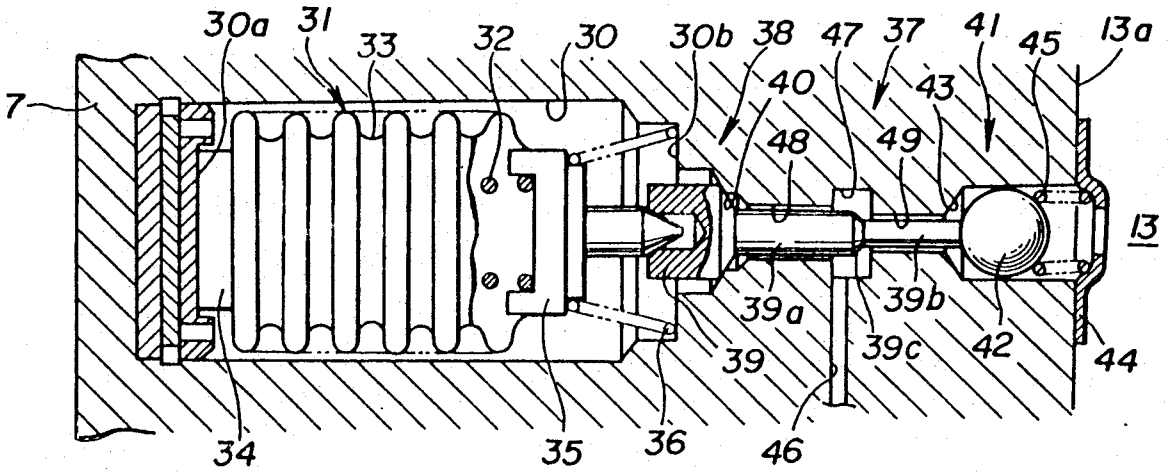

FIGS. 5 and 6 show a control cylinder 20 provided in the head cover 7. A control assembly 31 is housed in the control cylinder 30 so as to be movable in the direction of the axis of the control cylinder 30. The control assembly comprises a bellows 33 and a coil spring 32. By means of the bellows 33, the interior of the control cylinder 30 is divided into a bellows chamber 33*a* formed in the bellows 33 and a pressure control chamber formed between the bellows 33 and the control cylinder 30. The bellows chamber 33a is maintained at an essentially vacuum pressure. On the other hand, the pressure control chamber is in communication with the aspirator chamber 14. In FIGS. 5 and 6, the left-hand end 34 of the control assembly 31 is in contact with the left-hand, inside wall 30a of the control cylinder 30. On the other hand, the right-hand end 35 of the control assembly 31 engages a poppet valve body 39. A coil spring 36 is provided between the right-hand, inside wall 30b of the control cylinder 30 and the right-hand end 35 of the control assembly 31 to allow the control assembly 31 to bias in the left-hand direction in the drawings so as to be balanced with the biasing force of the coil spring 32. As shown in FIGS. 5 and 6, a control valve 37, which comprises a poppet valve 38 and a ball valve 41, is also provided in the head cover 7. The poppet valve 38 comprises the poppet valve body 39 engaging the right-hand end 35 of the control assembly 31 and a poppet valve seat 40. The poppet valve 38 may be opened and closed in accordance with lengthwise movement of the control assembly 31. The ball valve 41 comprises a ball valve body 42, a ball valve seat 43, a spring washer 44 and a coil spring 45. The spring washer 44 is mounted on a wall 13a of the discharge chamber 13 which is in communication with the ball valve 41. The coil spring 45 is provided between the spring washer 44 and the ball valve body 42 so as to allow the ball valve body 42 to bias toward the ball valve seat 43. The tip of the poppet valve body 39 of the poppet valve 38 is connected to one end of a large diameter first needle portion 39a. The other end of the first needle portion 39a is connected to one end of a small diameter second needle portion 39b. The other end of the second needle portion 39b is in contact with the ball valve body 42 so that the ball valve 41 may be opened and closed in accordance with the longitudinal movement of the control assembly 31. In addition, a communication chamber 47 is formed so as to surround the connecting portion 39c disposed between the first needle portion 39a and the second needle portion 39b. The communication chamber 47 is in communication with a pilot-pressure supply opening 46 which is in communication with the supply port 27a of the actuator cylinder 22. The communication chamber 47 is also in communication with the poppet valve 38 and the ball valve 41 through first and second openings 48 and 49, respectively.

As shown in FIG. 1, a thrust bearing 50 is provided between the front plate 2 and the rotatable disc 18 in order to allow the rotatable disc 18 to rotate smoothly. Thrust load of the rotor 4, which thrusts rotatable disc 18 against the front plate 2, is applied to the thrust bearing 50 so that the rotatable disc 18 can rotate smoothly.

In addition, a circumferential groove 18c is formed on the inner periphery 18b of the rotatable disc 18. A seal member 52 is inserted into the groove 18c. The inner periphery of the seal member 52 is in slidable contact with a front-side shaft 4a of the rotor 4 and the outer periphery of the seal member 52 is in slidable contact with the inner periphery 18d of the groove 18c. The seal member 52 may prevent the medium-pressure refrigerant or lubricating oil in the groove of the rotor 4, in which the vanes are inserted, from running into the aspirator chamber 14 or a bearing 53 which supports the shaft 4a of the rotor 4.

Figure 7:
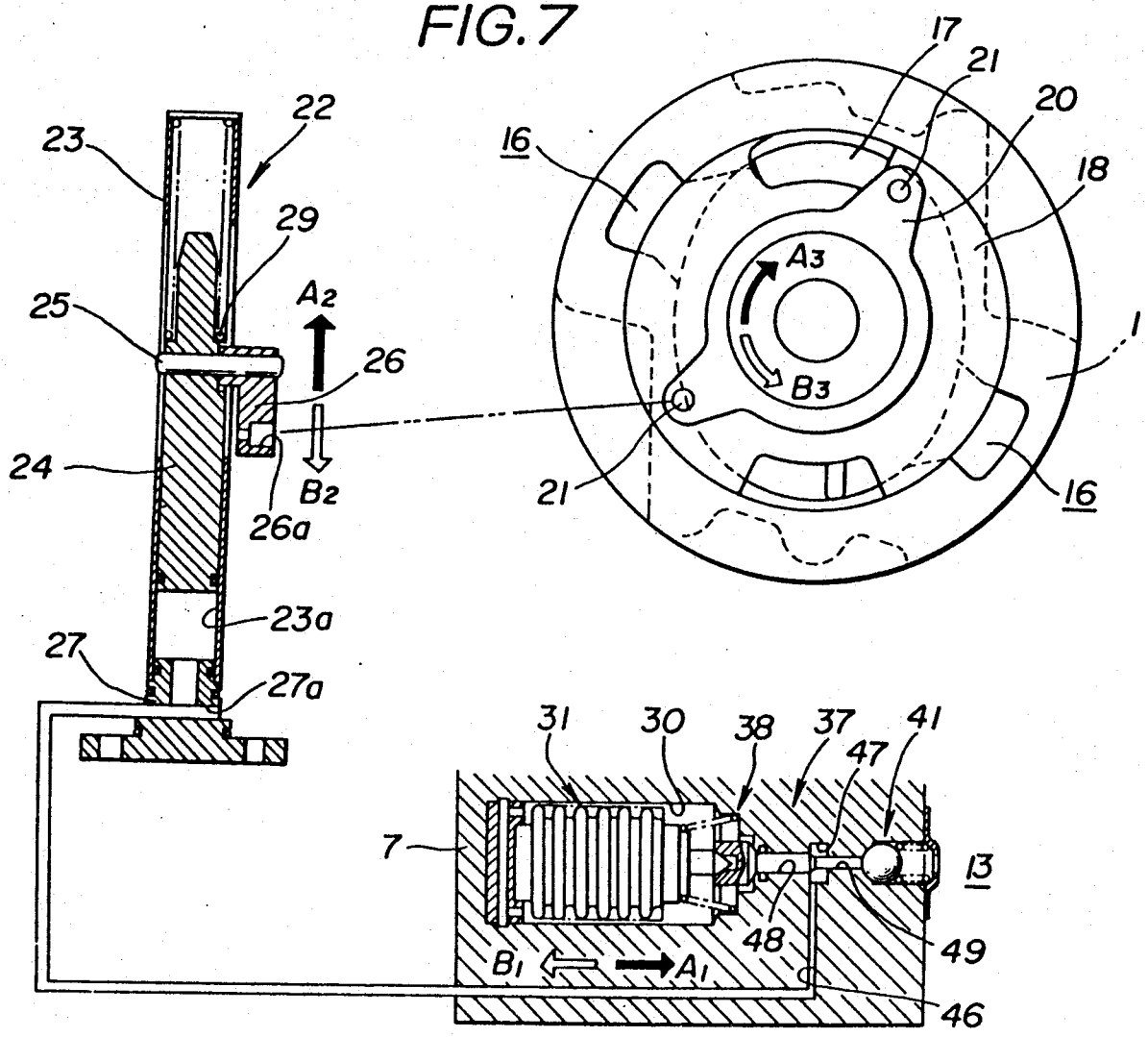
FIG. 7 is a schematic view showing operation of the control assembly and the control valves.

Referring to FIG. 7, operation of the invention is described below.

The revolving shaft of the rotor 4 may be connected to an engine of a vehicle or the like to be actuated. When the rotor 4 is actuated to rotate clockwise in FIG. 2, the vanes 5 project radially due to centrifugal force and back pressure of the vanes 5. As a result, the tips of the vanes 5 remain in contact with the cam surface 1a of the cam ring 1 as they rotate. Refrigerant gas is supplied to the interior of the compressor through the inlet 15. The refrigerant gas is compressed to become high-pressure, high-temperature gas to be supplied to an evaporator not shown through the discharge chamber 13. In this case, when refrigerant gas supply exceeds demand of the evaporator, for example, when discharge of the compressor is excessive relative to the cooling load of the evaporator, the pressure of the refrigerant gas, which returns from the evaporator to the compressor, is decreased since a part of liquid refrigerant is not changed to refrigerant gas to transferred to the compressor. Therefore, the inlet pressure of the compressor is decreased so that the pressure in the control cylinder 30 is decreased. As shown in FIG. 6, when the pressure in the control cylinder 30 is decreased, the biasing force of the coil spring 32 of the control assembly 31 becomes larger than that of the coil springs 36 and 45 so that the right-hand end 35 of the control assembly 31 is longitudinally moved in the direction of the arrow $A_1$ in FIG. 7. As a result, the poppet valve 38 is closed and the ball valve 41 is opened. As shown in FIG. 7, the pressure in the discharge chamber 13, i.e. the discharge pressure of the high-pressure compressor is supplied to the cylinder 23a of the actuator cylinder 22 through the second opening 49, the communication chamber 47, the pilot-pressure opening 46 and the supply port 27a of the actuator cylinder 22, so that the piston 24 is upwardly moved in the direction of the arrow $A_2$ against the biasing force of the coil spring 29. As a result, the rotatable disc 18 rotates in the direction of the arrow $A_3$ to increase the area of the by-pass port 17 to decrease the discharge of the compressor, so that the optimum amount of refrigerant gas can be supplied to the evaporator. On the other hand, when discharge of the compressor is not enough for the cooling load of the evaporator, the pressure of the refrigerant gas returned from the evaporator to the compressor is increased. Therefore, the inlet pressure of the compressor is increased, so that the pressure of the control cylinder 30, which is in communication with the aspirator chamber 14, is increased. As shown in FIG. 5, when the pressure in the control cylinder 30 is increased, the biasing force of the coil springs 36 and 45 becomes larger than that of the coil spring 32 of the control assembly 31 so that the control assembly 31 is longitudinally moved in the direction of the arrow $B_1$ in FIG. 7. As a result, the ball valve 41 is closed and the poppet valve 38 is opened due to the biasing force of the coil spring 45. As shown in FIG. 7, when the poppet valve 38 is opened, high-pressure in the cylinder 23a of the actuator cylinder 22 is supplied to the pressure in the control cylinder 30, i.e. the low, inlet pressure of the compressor through the supply port 27a of the actuator cylinder 22, the pilot-pressure opening 46, the communication chamber 47 and the first opening 48, so that the piston 24 is downwardly moved in the direction of the arrow $B_2$ due to the spring force of the coil spring 29. As a result, the rotatable disc 18 rotates in the direction of the arrow $B_3$ to decrease the area of the by-pass port 17 to increase the discharge of the compressor, so that the optimum amount of refrigerant gas can be supplied to the evaporator.

A process for controlling the discharge according to the cooling capacity is described below. For example, in cases where the compressor is actuated when the temperature surrounding the evaporator is high, i.e. when the outside air temperature and the temperature in the vehicle are high in summer, large amount of refrigerant gas is required for cooling, so that the flow from an evaporator to the compressor is increased, thereby the pressure of the refrigerant gas supplied to the compressor is increased. In this case, the control assembly 31 is moved in the left-hand direction, so that the ball valve is closed. When the ball valve is closed, the pressure in the actuator cylinder 22 becomes low, so that the piston is moved downwardly. When the piston is moved downwardly, the rotatable disc 18 rotates counterclockwise, so that discharge of the compressor is increased. When the compressor is actuated to supply large discharge, the temperature in the vehicle is decreased so that the cooling load required is decreased. Therefore, the inlet pressure is decreased. On the other hand, since the discharge pressure in the discharge chamber 13 is increased, the discharge pressure of the compressor supplied to the ball valve body 42 of the ball valve 41 is increased so that the biasing force for closing the ball valve 41 is increased. Therefore, in order to decrease the discharge flow, smaller inlet pressure is required. As a result, since the compressor is actuated while it supplies large discharge, the interior of the vehicle may be fully cooled. In this case, the flow of the refrigerant passing through the pipe line between the evaporator and the compressor of the air conditioner is increased, so that the pressure loss in the pipe line is increased, thereby the inlet pressure is decreased. Therefore, large discharge may be maintained.

Conversely, when the temperature surrounding the vehicle is low, i.e. when the outside air temperature is low and the only humidity within the vehicle is to be decreased, the flow from the evaporator to the compressor is decreased so that the inlet pressure of the compressor is decreased since the flow of the refrigerant gas required is not so large. Therefore, the control assembly 31 is moved in the right-hand direction, so that the ball valve 41 is opened, thereby the pressure in the actuator cylinder 22 is increased to allow the piston 24 to move upwardly. As a result, the rotatable disc 18 rotates clockwise by means of the ring plate 20, so that the compressor is actuated to supply a small discharge. Since the dischare is small, the pressure in the discharge chamber 13 is decreased, so that the biasing force, by which the ball valve 41 is closed, is decreased. Therefore, in order to increase the discharge, higher inlet pressure is required. As a result, since the compressor can actuate while it supplies small discharge, it is possible to decrease power loss.

In the aforementioned preferred embodiment, although the bellows 33 is used in the control assembly, a piston, a diaphragm or the like can be substituted for the bellows 33.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A variable capacity rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber into which said low-pressure fluid is introduced for compression;

passage means for defining a by-pass passage establishing communication between said low-pressure chamber and said compression chamber, said by-pass passage being arranged to be exposable to essentially the entire cross-sectional area of said compression chamber so as to establish communication between said low-pressure chamber and said compression chamber;

rotary closure member associated with said by-pass passage for varying the opening area and position at which said by-pass passage is exposed to said compression chamber so as to control the amount of said low-pressure fluid by-passed from said compression chamber to said low-pressure chamber through said by-pass passage; and actuating means, mechanically associated with said rotary closure member, for actuating said rotary closure member for controlling the amount of said low-pressure fluid, which is by-passed from said compression chamber to said low-pressure chamber through said passage means, in response to pressures in said low-pressure and high-pressure chambers, wherein said actuating means defining therein an internal space which includes a rectilinearly movable member mechanically connected to said closure member and being thrustingly driven for causing angular displacement of said rotary closure member.

2. A rotary compressor as set forth in claim 1, wherein said rotary closure member comprises a disc-shaped member in which a by-pass opening is provided at the circumference thereof, said disc-shaped member being rotatably provided on an end wall of said compression chamber.

3. A variable capacity rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber for introducing said low-pressure fluid thereinto for compression;

passage means for defining a by-pass passage establishing communication between said low-pressure chamber and said compression chamber, said by-pass passage having end openings exposed to said low-pressure chamber and said compression chamber;

rotary closure member associated with one of said end openings of said by-pass passage for varying the open area of said end opening so as to control the amount of said low-pressure fluid by-passed from said compression chamber to said low-pressure chamber through said by-pass passage;

actuating means, mechanically associated with said rotary closure member, for actuating said rotary closure member for controlling the amount of said low-pressure fluid, which is by-passed from said compression chamber to said low-pressure chamber through said passage means, said actuating means defining therein an internal space which houses therein a rectilinearly movable member mechanically connected to said closure member, said movable member dividing said internal space into first and second chambers and being thrustingly driven for causing angular displacement of said rotary closure member; and control means for establishing the communication between said first chamber and said low-pressure and high-pressure chambers for selectively supplying said low-pressure and high-pressure fluids to said first chamber so as to actuate said movable member in accordance with pressures in said low-pressure and high-pressure chambers.

4. A rotary compressor as set forth in claim 3, wherein said rotary closure member comprises a disc-shaped member in which a by-pass opening is provided at the circumference thereof, said disc-shaped member being rotatably provided on an end wall of said compression chamber.

5. A variable capacity rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber for introducing said low-pressure fluid thereinto for compression;

passage means for defining a by-pass passage establishing communication between said low-pressure chamber and said compression chamber, said by-pass passage having long arc-shaped end openings exposed to said low-pressure chamber and said compression chamber;

rotary closure member associated with one of said end openings of said by-pass passage for varying the opening area of said end opening so as to control the amount of said low-pressure fluid by-passed from said compression chamber to said low-pressure chamber through said by-pass passage, said rotary closure member comprising a disc-shaped member which is formed with an arc-shaped by-pass opening at the circumference thereof to extend beside the outer periphery so as to correspond to said end opening of said by-pass passage and which is rotatably provided on an end wall of said compression chamber;

actuating means, mechanically associated with said rotary closure member, for actuating said rotary closure member for controlling the amount of said low-pressure fluid, which is by-passed from said compression chamber to said low-pressure chamber through said passage means, said actuating means defining therein an internal space which houses therein a movable member mechanically connected to said closure member, said movable member dividing said internal space into first and second chambers and being thrustingly driven for causing angular displacement of said rotary closure member; and control means for establishing the communication between said first chamber and said low-pressure and high-pressure chambers for selectively supplying said low-pressure and high-pressure fluids to said first chamber so as to actuate said movable member in accordance with pressures in said low-pressure and high-pressure chambers.

6. A rotary compressor as set forth in claim 4, wherein said actuating means comprises an actuator cylinder, in which said movable member serving as a piston is housed, said piston causing said disc-shaped member to rotate; and wherein said control means comprises a control valve supplying pressure to said actuator cylinder thereby actuating said piston, a control cylinder having a control chamber which is in communication with said low-pressure chamber, and a control assembly which is provided in said control cylinder and which moves in the direction of the axis thereof in accordance with pressures in said low-pressure and high-pressure chambers so as to actuate said control valve.

7. A rotary compressor as set forth in claim 6, wherein said control valve comprises a poppet valve connected to said control assembly and a ball valve which can be in communication with said high-pressure chamber.

8. A rotary compressor as set forth in claim 7, wherein said compressor is used in an air conditioner including an evaporator.

9. A rotary compressor as set forth in claim 8, wherein said ball valve is opened to allow said rotary closure member to rotate by means of said actuator cylinder so as to increase the open area of said end opening of said by-pass passage when discharge of said compressor is excessive relative to the cooling load of said evaporator connected to said compressor and wherein said poppet valve is opened to allow said rotatable disc to rotate by means of said actuator cylinder so as to decrease the open area of said end opening of said by-pass passage when discharge of said compressor is not enough to satisfy the cooling demand of said evaporator.

10. A rotary compressor as set forth in claim 9, wherein said control assembly comprises a bellows and a coil spring.

11. A variable capacity rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber into which said low-pressure fluid is introduced for compression;

passage means for defining a by-pass passage establishing communication between said low-pressure chamber and said compression chamber, said by-pass passage being arranged to be exposable to essentially the entire cross-sectional area of said compression chamber so as to establish communication between said low-pressure chamber and said compression chamber;

rotary closure member associated with said by-pass passage for varying the open area and position at which said by-pass passage is exposed to said compression chamber so as to control the amount of said low-pressure fluid by-passed from said compression chamber to said low-pressure chamber through said by-pass passage; and actuating means, mechanically associated with said rotary closure member, for actuating said rotary closure member for controlling the amount of said low-pressure fluid, which is by-passed from said compression chamber to said low-pressure chamber through said passage means, in response to pressures in said low-pressure and high-pressure chambers, wherein said actuating means defining therein an internal space which includes a movable member mechanically connected to said closure member and being thrustingly driven for causing angular displacement of said rotary closure member, said actuating means comprising an actuator cylinder housing therein a piston which causes said disc-shaped member to rotate, a control valve supplying pressure to said actuator cylinder thereby actuating said piston, a control cylinder having a control chamber which is in communication with said low-pressure chamber, and a control assembly which is provided in said control cylinder and which moves in the direction of the axis thereof in accordance with pressures in said low-pressure and high-pressure chambers so as to actuate said control valve.

12. A rotary compressor as set forth in claim 11, wherein said control valve comprises a poppet valve connected to said control assembly and a ball valve which is able to be in communication with said high-pressure chamber.

13. A rotary compressor as set forth in claim 12, wherein said compressor is used in an air conditioner including an evaporator.

14. A rotary compressor as set forth in claim 13, wherein said ball valve is opened to allow said rotary closure member to rotate by means of said actuator cylinder so as to increase the open area of said by-pass passage when discharge of said compressor is excessive relative to the cooling load of said evaporator connected to said compressor and wherein said poppet valve is opened to allow said rotatable disc to rotate by means of said actuator cylinder so as to decrease the open area of said by-pass passage when discharge of said compressor is not enough to satisfy the cooling demand of said evaporator.

15. A rotary compressor as set forth in claim 13, wherein said control assembly comprises a bellows and a coil spring.

* * * * *